United States Patent [19]

Watanabe et al.

[11] Patent Number: 4,814,551

[45] Date of Patent: Mar. 21, 1989

[54] ANTICORROSIVE INSULATOR

[75] Inventors: Akihiro Watanabe, Hashima; Shigeo Mori, Kuwana, both of Japan

[73] Assignee: NGK Insulators, Ltd., Nagoya, Japan

[21] Appl. No.: 149,161

[22] Filed: Jan. 27, 1988

[30] Foreign Application Priority Data

Feb. 11, 1987 [JP] Japan ..... 62-29090

[51] Int. Cl.[4] ..... H01B 17/08; H01B 17/38; H01B 17/50

[52] U.S. Cl. ..... 174/189; 174/182; 174/211

[58] Field of Search ..... 174/140 C, 141 C, 182, 174/186, 188, 189, 196, 211; 264/DIG. 54

[56] References Cited

U.S. PATENT DOCUMENTS 2,135,326 11/1938 Calland ..... 174/189 X

OTHER PUBLICATIONS

*Thomas Insulators Catalog No. 40,* published by the R. Thomas and Sons Co., Lisbon, Ohio, May 1, 1940, Section A, p. 3, copy in 174–189.

*Primary Examiner*—Laramie E. Askin

*Attorney, Agent, or Firm*—Parkhurst, Oliff & Berridge

[57] ABSTRACT

The disclosed anticorrosive insulator has an insulator body with a shed radially extending from a central core thereof and a metal cap cemented to the core of the insulator body so as to cover the core. A gap of 2–10 mm is provided between the lower end of the metal cap and the upper surface of the shed. A recess may be formed on the lower end of the cementing agent layer between the metal cap and the core of the insulator body, which recess extends away from the upper surface of the shed.

3 Claims, 5 Drawing Sheets

ANTICORROSIVE INSULATOR

BACKGROUND OF THE INVENTION

1. Field of the Invention

This invention relates to an anticorrosive insulator such as an anticorrosive suspension insulator for use in insulator strings to be supported by arms of transmission line towers.

2. Related Art Statement

Referring to FIG. 6, a typical suspension insulator uses an insulator body 1 having a shed 1*a* extending radially from a central core 1*c*. A metal cap 3 is firmly secured to the top of the core 1*c* by cement 2. A metal pin 4 is inserted to the inside of the core 1*c* and secured thereto by cement 2*a*. In the conventional suspension insulator, the spacing or the gap g (FIG. 7) between the lower end of the metal cap 3 and the upper surface of the shed 1*a* has been less than 2 mm. As shown in FIG. 7, the bottom surface of the cement 2 between the metal cap 3 and the core 1*c* is generally finished flush with the lower end of the metal cap 3.

If the suspension insulator is used in a DC (direct current) power transmission line in such a manner that the polarity in the metal cap 3 is positive and the polarity in the metal pin 4 is negative, a surface leakage current flows from the metal cap 3 to the metal pin 4 along the surface of the shed 1*a*, and such leakage current causes electrochemical corrosion (to be referred to as electric corrosion hereinafter) at the lower end of the metal cap 3. Since the spacing between the lower end of the metal cap 3 and the upper surface of the shed 1*a* is less than 2 mm in conventional suspension insulators, and since the bottom surface of the cement 2 is flush with the lower end of the metal cap 3, corrosion products due to the above electric corrosion collect in the very small space surrounded by the metal cap 3, the bottom surface of the cement 2, and the shed 1*a*.

As the amount of the corrosion products deposited on the sturdy metal cap 3 increases, the comparatively hard corrosion products tend to generate a local pressure on the surface of the shed 1*a*. When the stress concentration in the shed 1*a* due to such local pressure exceeds a certain limit, cracks C are produced in the shed 1*a* of the insulator body 1, as shown in FIG. 8. Susceptibility to such cracks C due to electric corrosion is a weak point of the conventional insulators, because the presence of the cracks C weakens the insulator and invites breakdown of the insulator upon exposure to electric and mechanical stresses.

SUMMARY OF THE INVENTION

Therefore, an object of the present invention is to solve the above-mentioned weak point of the prior art by providing an anticorrosive insulator. The anticorrosive insulator is particularly suitable for insulator strings of DC power transmission lines.

An anticorrosive insulator according to a first embodiment comprises an insulator body with a core and a shed extending radially from the core, and a metal cap which is cemented onto the core so as to cover it. In the insulator of this embodiment, a gap of 2–10 mm is provided between the lower end of the metal cap and the upper surface of the shed of the insulator body.

In another embodiment of the invention, the width of the above-mentioned gap between the lower end of the metal cap and the upper surface of the shed is in a range of 3–6 mm. The lower end of the metal cap may be of an edge shape.

An anticorrosive insulator of a third embodiment has a similar structure to that of the first embodiment, except that an upward recess is formed at the lower end of a cementing agent layer between the metal cap and the core of the insulator body while the width of the above-mentioned gap between the lower end of the metal cap and the upper surface of the shed is left arbitrary. The upward recess extends in a direction away from the upper surface of the shed.

Once the gap of 2–10 mm is provided between the lower end of the metal cap and the upper surface of the shed of the insulator body, even if corrosion products are generated from the lower end of the metal cap by the electric corrosion, the corrosion products easily escape from the narrow space between the bottom of the metal cap and the top of the shed through the above-mentioned gap. Thus, accumulation of the corrosion products in the narrow space is avoided, and generation of any local pressure toward the shed top surface from the bottom of the metal cap is prevented, and the shed is protected against cracking due to local stress concentration which may be otherwise caused thereon by the local pressure from the accumulated corrosion products.

Similarly, once the upward recess is provided at the lower end of the cementing agent layer between the metal cap and the core of the insulator body, the above-mentioned corrosion products easily escape into the upward recess. Thus, generation of any forceful local pressure from the accumulated corrosion products toward the top surface of the shed is prevented.

BRIEF DESCRIPTION OF THE DRAWINGS

For a better understanding of the invention, reference is made to the accompanying drawings, in which.

Throughout different views of the drawings, the following symbols are used.

| | |
|---|---|
| 1: insulator body | 1a: a shed |
| 1b: an under-rib | 1c: a core |

-continued

| | |
|---|---|
| 2,2a: cement | 3: a metal cap |
| 4: a metal pin | 3a: a socket |
| C: a crack | g: a gap |
| | H: a recess |

DESCRIPTION OF THE PREFERRED EMBODIMENTS

An embodiment of the anticorrosive insulator of the invention, in the form of a suspension insulator, will be described now by referring to FIG. 1 through FIG. 5.

Figure 3:
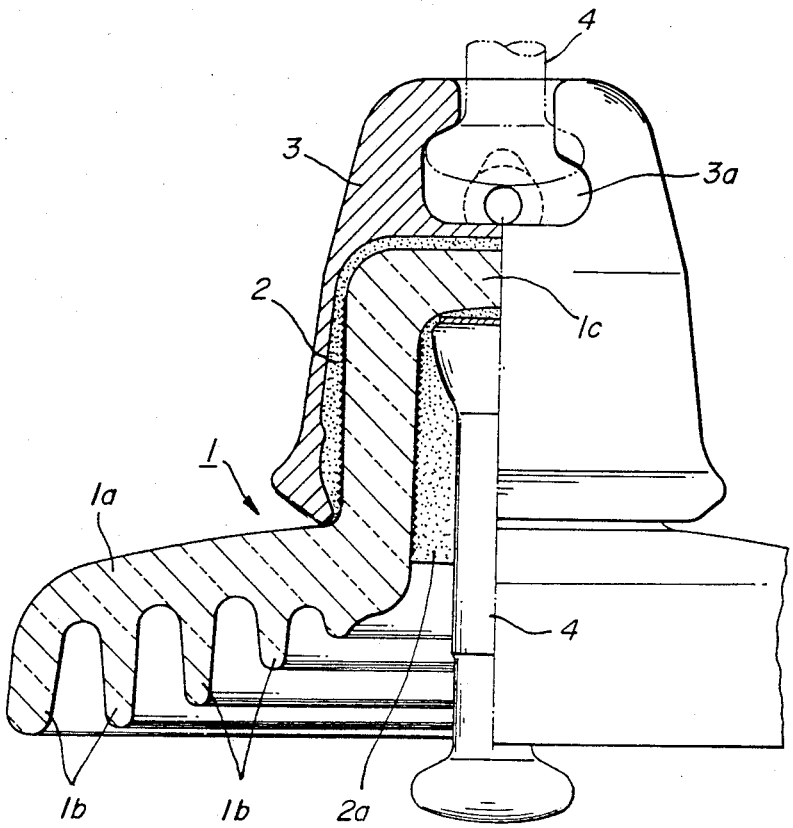
FIG. 3 is a partially cutaway vertical sectional view of an anticorrosive suspension insulator according to the invention.

Referring to FIG. 3, an insulator body 1 of the anticorrosive suspension insulator has a central core 1*c* of hollow cylindrical shape with a closed top, a shed 1*a* extending radially from the core lc, and a plurality of annular under-ribs 1*b* depending from the lower surface of the shed 1*a* in a concentric manner. A metal cap 3 is firmly secured onto the outer surface of the core 1*c* by cement 2 so as to cover the core lc. A socket 3*a* is formed on the top portion of the metal cap 3 so that the lower end of a metal pin 4 of another suspension insulator immediately above fits in the socket 3*a*. *The upper portion of each metal pin 4 is firmly secured to the inside of the core 1c* by cement 2*a*. The lower end of the metal pin 4 of each suspension insulator may fit in the socket 3*a* of the metal cap 3 of another suspension insulator immediately below. Thus, a number of suspension insulators can be connected by the pin-socket engagement so as to form an insulator string.

Figure 1:
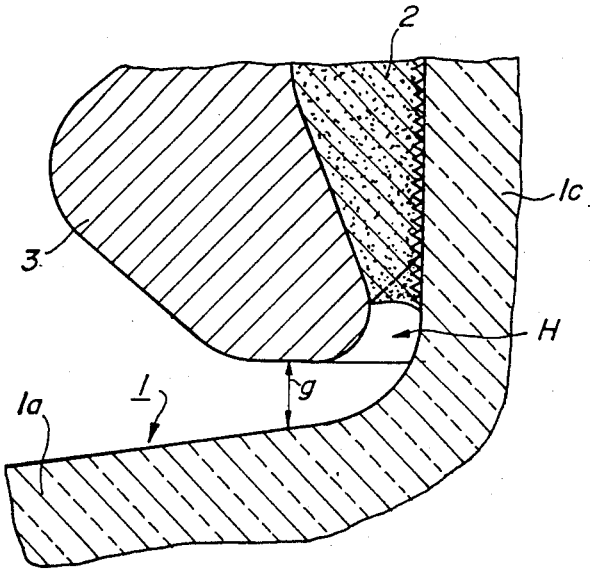
FIG. 1 is a partial sectional view of the essential portion of an anticorrosive suspension insulator according to the invention.
Figure 2:
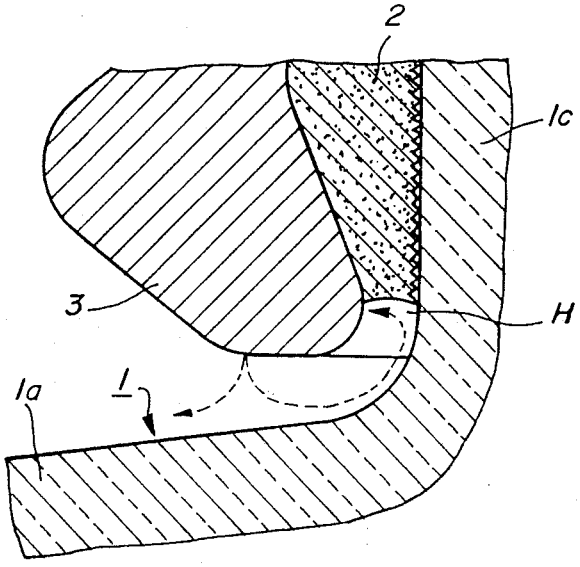
FIG. 2 is a partial sectional view showing the locus of movement of corrosion products when the lower end of a metal cap of the anticorrosive insulator is electrochemically corroded.

As shown in FIG. 1, a gap g of 2–10 mm is provided between the lower end of the metal cap 3 and the upper surface of the shed 1*a*. The width of the gap g is selected on the basis that, from the standpoint of corrosion resistivity, the wider the better, but from the standpoint of mechanical strength, excessively wide gap g results in an improper positional relationship between the metal cap 3 and the metal pin 4 and leads to a sizeable reduction of the mechanical strength. In fact, the inventors carried out tests on the corrosion resistivity and the mechanical strength of specimens of the anticorrosive suspension insulators of the invention.

Figure 4:
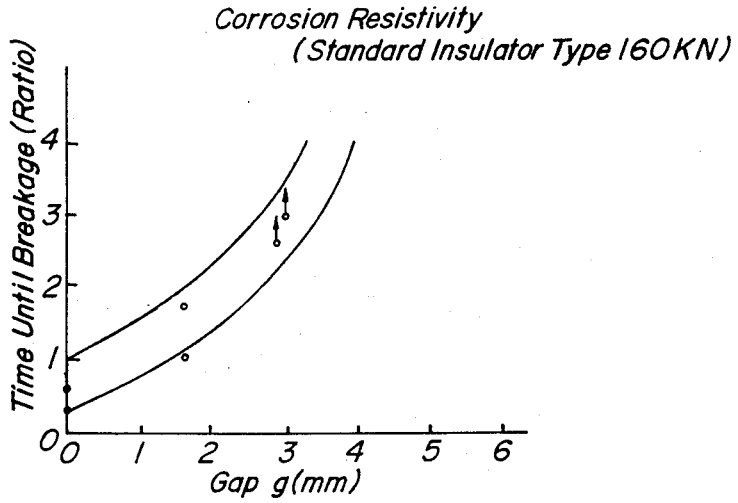
FIG. 4 is a graph showing the relationship between the corrosion resistivity of an insulator and the size of a gap from the bottom of a metal cap to the top of a shed in the insulator.
Figure 5:
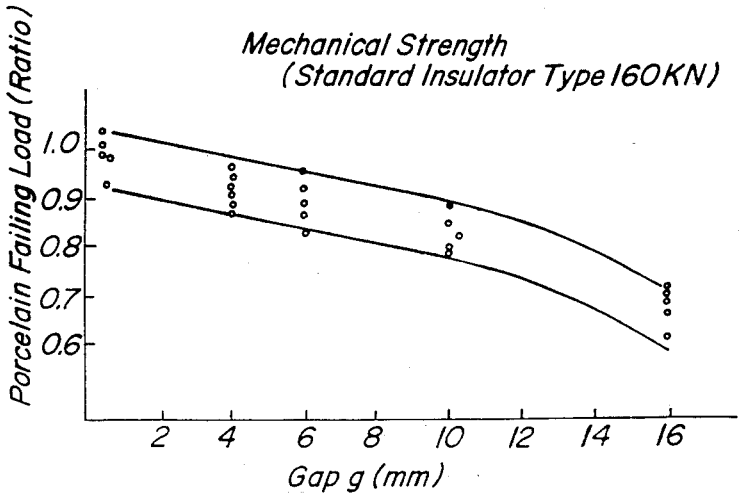
FIG. 5 is a graph showing the relationship between the mechanical strength of an insulator and the size of a gap from the bottom of a metal cap to the top of a shed in the insulator.

FIG. 4 and FIG. 5 show the typical comparative values of the corrosion resistivity and the mechanical strength of the tested specimens respectively. More particularly, as can be seen from FIG. 4 when the gap g was wider than about 2 mm, the time until shed breakage was very long. On the other hand, as can be seen from FIG. 5 when the width of the gap g exceeded 10 mm, the mechanical failing load of the insulator body, which was porcelain, reduced quickly.

Accordingly, the width of the gap g was determined to be 2–10 mm by considering its effects on both the corrosion resistivity and the mechanical strength of the insulator.

In the embodiment of FIG. 1, the lower end of the cement 2 between the core 1*c* and the metal cap 3 is recessed from the lower end of the metal cap 3, namely, the lower end of the cement 2 is recessed in a direction away from the upper surface of the shed 1*a*. Thus, an annular recess H with a downward opening is defined by a part of the outer surface of the core 1*c*, the lower end surface of the cement 2, and a part of the inner surface of the metal cap 3. Such recess H may be made by using a mold (not shown) when the metal cap 3 is secured to the core 1*c*, which mold is to raise the lower end surface of the cement 2. The shape of the recess H is determined so as to maintain a reasonable distribution of mechanical load thereat. For instance, the lower end surface of the cement 2 may be so inclined that its distance from the top surface of the shed 1*a* increases as it comes closer to the core lc, as shown by the dash-dot line of FIG. 1.

The function of the anticorrosive suspension insulator of the above structure will be explained now.

A number of the anticorrosive suspension insulators are assembled into an insulator string by the above pin-socket connection, and the thus assembled insulator strings are suspended from supporting structures such as power transmission line towers. When the insulator is used on a DC power transmission line while keeping the polarity of the metal cap 3 positive and that of the metal pin 4 negative, the lower end of the metal cap 3 is exposed to the electric corrosion caused by a surface leakage current from the metal cap 3 to the metal pin 4 through the surface of the shed 1*a*. Corrosion products due to the electric corrosion deposit on the lower end surface of the metal cap 3, and such deposit of the corrosion products swells downward. Referring to the dotted lines of FIG. 2, when the deposit reaches the upper surface of the shed 1*a*, the corrosion products escape away from the core 1*c* and/or into the recess H through the gap g of 2–10 mm.

Thus, with the structure of the invention, pressure buildup by the stuffing of the corrosion products in the narrow space between the bottom of the metal cap 3 and the top of the shed 1*a* never occurs, so that generation of any local pressure on the shed 1*a* by such pressure buildup is completely prevented. Accordingly, the shed 1*a* is freed from the risk of cracking by such local pressure.

The embodiment of FIG. 1 uses the combination of the gap g of 2–10 mm of a first embodiment and the recess H of a third embodiment. However, the recess H of the third can be dispensed with, namely, the gap g of 2–10 mm according to the first embodiment by itself ensures the above escape of the corrosion products and prevents harmful accumulation of the corrosion products in the space between the metal cap 3 and the shed 1*a*.

In the third embodiment it is possible that, only the recess H of above-mentioned combination is used, and the width of the gap g is left arbitrary. The inventors have found that the recess H provides a space to which the corrosion products escape, and local pressure buildup is eliminated.

The invention is not restricted to the embodiments described above. For instance, any of the following modifications is possible within the scope of the invention: namely, (1) To use a metal cap 3 with an edge-shaped bottom portion. With the edge-shaped bottom, the pressure due to the corrosion products can be easily diverted, and the time until the failing of the shed 1*a* can be made long.

(2) To use a gap g of 3–6 mm. The gap g of this range is most effective.

(3) Instead of the illustrated anticorrosive suspension insulator, to provide an anticorrosive insulator of another type with a core and a shed, such as an anticorrosive long rod insulator.

As described in detail in the foregoing, an anticorrosive insulator according to the first embodiment uses a gap g of 2–10 mm between the lower end of a metal cap and the upper surface of a shed, so that even when the lower end of the metal cap is electrochemically corroded into corrosion products which are to be fed into a space between the metal cap and the shed, such corrosion products are allowed to escape to the outside of such space through the above-mentioned gap. Thus, an outstanding effect is fulfilled in that the pressure buildup by the accumulation of the corrosion products in the above-mentioned space is prevented, so that generation of any forceful local pressure on the shed from the metal cap is also prevented, and the risk of the shed breakdown by stress concentration due to such local pressure is completely eliminated.

Similarly, with the third embodiment which uses a recess H within the metal cap at the lower end of a metal cap, the corrosion products are allowed to move into the recess H. Thus, the third embodiment also fulfills an outstanding effect by preventing generation of a high local pressure to act on the top surface of the shed, so as to completely eliminate the risk of the breakage of the shed due to stress concentration caused by such high local pressure.

Although the invention has been described with a certain degree of particularly, it is understood that the present disclosure has been made only by way of example and that numerous changes in details of construction and the combination and arrangement of parts may be resorted to without departing from the scope of the invention as hereinafter claimed.

What is claimed is:

1. An anticorrosive insulator comprising:

an insulator body having a core and a shed extending radially outward from said core, said core having an outer surface and an inner surface, said shed having an upper surface and a lower surface; and a metal cap cemented onto said outer surface of said core, said metal cap having a lower end upwardly spaced from said upper surface of said shed by a distance of 3–10 mm.

2. An anticorrosive insulator according to claim 1, wherein said lower end of said metal cap is of an edge shape.

3. An anticorrosive insulator comprising:

an insulator body having a core and a shed extending radially outward from said core, said core having an outer surface and an inner surface, said shed having an upper surface and a lower surface;

a metal cap joined to said outer surface of said core, said metal cap having a lower end upwardly spaced from said upper surface of said shed by a distance of 3–10 mm; and a cementing agent layer interposed between said metal cap and said outer surface of said core, said cementing agent layer having a lower end proximate said upper surface of said shed and upwardly spaced from said upper surface and said lower end of said metal cap.

* * * * *

UNITED STATES PATENT AND TRADEMARK OFFICE

CERTIFICATE OF CORRECTION

PATENT NO. : 4,814,551

DATED : March 21, 1989

INVENTOR(S) : Akihiro WATANABE et al.

Figure 6:
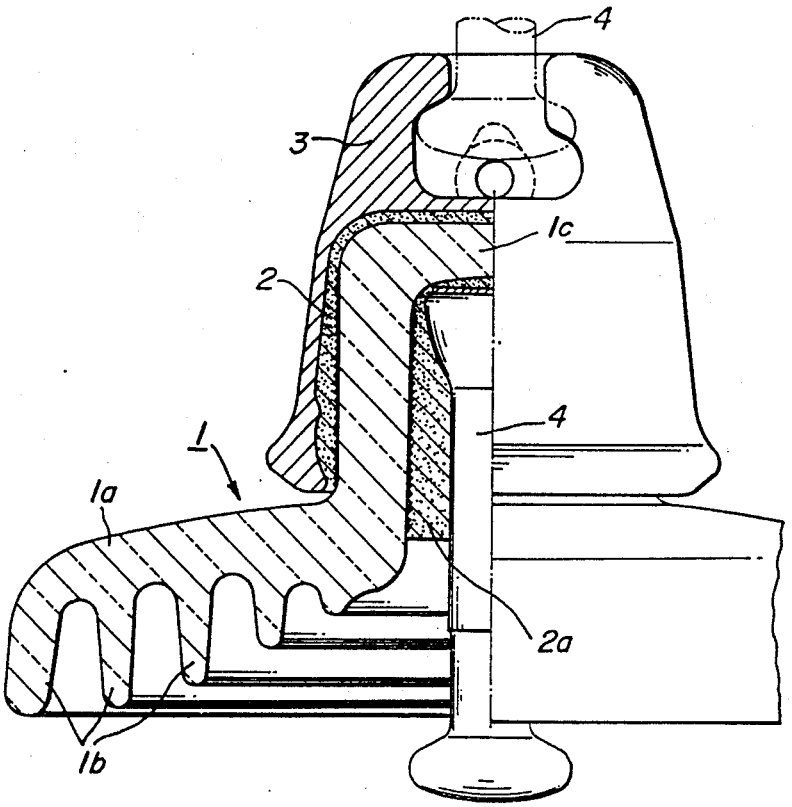
FIG. 6 PRIOR ART
FIG. 6 is a partially cutaway vertical sectional view of a conventional suspension insulator.
Figure 7:
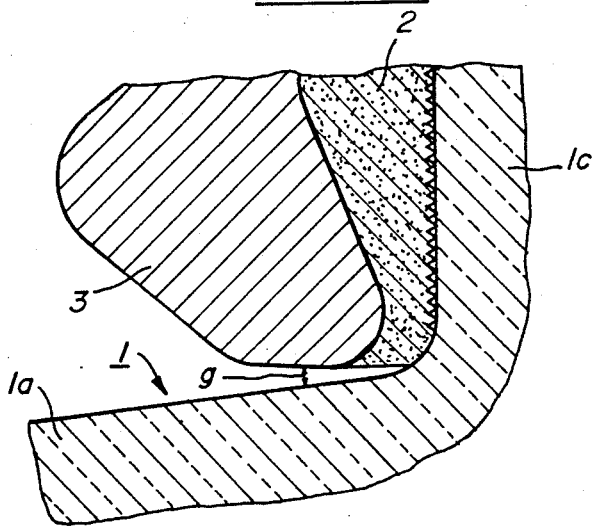
FIG. 7 PRIOR ART
FIG. 7 is a partial sectional view of the bottom portion of a metal cap in the conventional suspension insulator.
Figure 8:
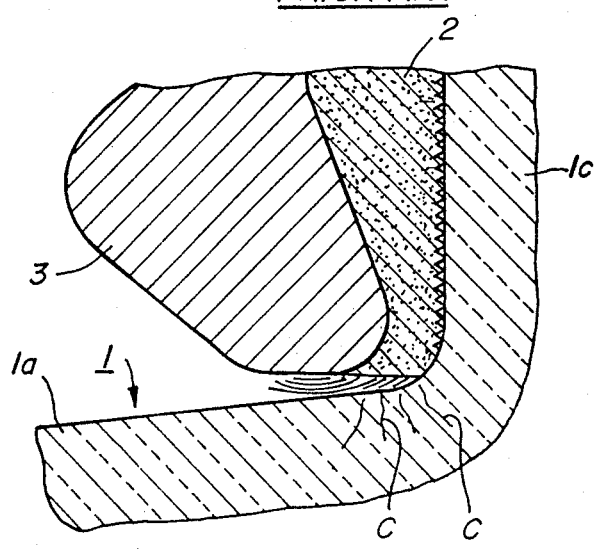
FIG. 8 PRIOR ART
FIG. 8 is a similar partial sectional view showing corrosion products from the metal cap.

It is certified that error appears in the above-identified patent and that said Letters Patent is hereby corrected as shown below:

In the Drawings, sheet 2 of 5, "Fig 3" should read --Fig. 6 - Prior Art--;

sheet 4 of 5, "Fig 6 - Prior Art" should read --Fig. 3--.

Signed and Sealed this

Fourteenth Day of January, 1992

*Attest:*

HARRY F. MANBECK, JR.

*Attesting Officer*

*Commissioner of Patents and Trademarks*